US007721846B2

(12) United States Patent
Swift et al.

(10) Patent No.: US 7,721,846 B2
(45) Date of Patent: May 25, 2010

(54) SOUND ABSORBING MATERIAL

(75) Inventors: Mark Johnathan Swift, West Yorkshire (GB); David Charles Hothersall, West Yorkshire (GB); Kirill Vjatcheslavovitch Horoshenkov, West Yorkshire (GB)

(73) Assignee: Ventures and Consultancy Bradford Limited, West Yorkshire (GB)

( * ) Notice: Subject to any disclaimer, the term of this patent is extended or adjusted under 35 U.S.C. 154(b) by 144 days.

(21) Appl. No.: 10/344,813

(22) PCT Filed: Aug. 14, 2001

(86) PCT No.: PCT/GB01/03626

§ 371 (c)(1),
(2), (4) Date: Jun. 12, 2003

(87) PCT Pub. No.: WO02/15168

PCT Pub. Date: Feb. 21, 2002

(65) Prior Publication Data

US 2004/0099476 A1 May 27, 2004

(30) Foreign Application Priority Data

Aug. 15, 2000 (GB) ..... 0019913.3

(51) Int. Cl.
*E04B 1/82* (2006.01)
*E04B 1/84* (2006.01)
*E04B 1/74* (2006.01)

(52) U.S. Cl. ..... 181/293; 181/286

(58) Field of Classification Search ..... 181/286, 181/284, 285, 287, 288, 289, 290–296
See application file for complete search history.

(56) References Cited

U.S. PATENT DOCUMENTS

| | | | | | |
|---|---|---|---|---|---|
| 3,132,714 | A | * | 5/1964 | Nadler et al. | 181/286 |
| 3,137,364 | A | * | 6/1964 | Akerson | 181/290 |
| 3,504,462 | A | * | 4/1970 | Akerson | 52/145 |
| 3,504,463 | A | * | 4/1970 | Akerson | 52/145 |
| 3,961,682 | A | * | 6/1976 | Dausch et al. | 181/290 |
| 3,985,198 | A | | 10/1976 | Kurtze et al. | |
| 4,077,491 | A | * | 3/1978 | Hankel | 181/290 |
| 4,097,633 | A | * | 6/1978 | Focht | 428/138 |
| 4,272,572 | A | * | 6/1981 | Netherly | 428/35.5 |
| 4,842,097 | A | * | 6/1989 | Woodward et al. | 181/286 |
| 4,883,143 | A | | 11/1989 | Lagier | |
| 4,940,112 | A | * | 7/1990 | O'Neill | 181/290 |
| 5,266,143 | A | * | 11/1993 | Albera et al. | 156/245 |
| 5,518,806 | A | * | 5/1996 | Eder et al. | 428/218 |
| 5,594,216 | A | | 1/1997 | Yasukawa et al. | |
| 5,658,656 | A | * | 8/1997 | Whitney et al. | 428/304.4 |
| 5,691,037 | A | * | 11/1997 | McCutcheon et al. | 428/172 |

(Continued)

FOREIGN PATENT DOCUMENTS

DE 19539309 4/1997

(Continued)

*Primary Examiner*—Edgardo San Martin
(74) *Attorney, Agent, or Firm*—Michael Best & Friedrich LLP

(57) ABSTRACT

Sound absorbing board (10) is made from recycled high density foam granulate (12) that has been mixed with a binder (14) and consolidated under pressure. Pores (16) are present in spaces between the granules. Each granule includes small pores (18). Sound is absorbed by thermal diffusion and viscous friction.

32 Claims, 3 Drawing Sheets

U.S. PATENT DOCUMENTS

| | | | | |
|---|---|---|---|---|
| 5,744,763 | A | 4/1998 | Iwasa et al. | |
| 6,155,379 | A * | 12/2000 | Nakagawa | 181/256 |
| 6,186,270 | B1 * | 2/2001 | Roller et al. | 181/286 |
| 6,228,478 | B1 | 5/2001 | Kliwer et al. | |
| 6,601,673 | B2 * | 8/2003 | Murakami et al. | 181/293 |

FOREIGN PATENT DOCUMENTS

| | | | |
|---|---|---|---|
| EP | 0509603 | | 10/1992 |
| EP | 0588182 | | 3/1994 |
| EP | 0657281 | | 6/1995 |
| EP | 0 664 659 | A2 | 7/1995 |
| EP | 0 762 382 | A1 | 3/1997 |
| FR | 2 405 818 | | 5/1979 |
| JP | 06173223 | A * | 6/1994 |
| WO | WO 9853444 | | 11/1998 |

* cited by examiner

SOUND ABSORBING MATERIAL

BACKGROUND AND SUMMARY OF THE INVENTION

The present invention relates to sound absorbing material, to a method of using sound absorbing material and to a method of making sound absorbing material.

In a known sound absorbing material relatively soft, low density particles are glued together with the glue filling the spaces between the particles. The particles are approximately 5 to 20 mm in diameter. However such material is only able to absorb a relatively small amount of high frequency sound and a significant amount of medium and low frequency sound is reflected or transmitted through the material rather than being absorbed.

It is an object of the present invention to attempt to improve the acoustic performance of consolidated particulate material and to overcome at least some of the above described or other disadvantages.

According to one aspect of the present invention sound absorbing material includes a plurality of pieces connected together, each piece including pores extending at least partially into the pieces, the material also including openings extending at least partially through the material between adjacent pieces.

The pieces may comprise foam such as polyurethane foam. The foam may be recycled. The foam may be a high density foam or medium density foam, for instance having a density of more than 25 or less than 150 or preferably in the region of 100 to 120 kg/m$^3$, before the pieces are connected together.

The pieces may be connected together by adhesion, such as by a binder. The binder may comprise less than 50% or less than 40% or more than 10% or more than 20% or in the region of 35% of the mass of the material.

The material may have been compressed down during manufacture by more than 25% or less than 75% or preferably in the region of 50%.

The porosity of the material may be less than 80% or more than 20% or more than 40% or in the region of 65%.

The material may have an initial porosity, before compression of more than 80% or in the region of 95%.

The material prior to consolidation may have a flow resistivity of less than 300 or less than 150 or more than 20 or more than 40 or in the region of 80 kPascals×sec/m$^2$.

The material may have a Youngs modulus of more than $10^5$ or less than $10^9$ or approximately $10^7$ Pascals.

The material may have a density of less than 800 or less than 600 or more than 100 or more than 200 or in the region of 400 kg/m$^3$.

The ratio of the space provided by the pores to the total space in the material may be more than 60 or more than 70 or more than 80 or in the region of 85%. The ratio of the space provided by the openings to the total space in the material may be less than 40 or less than 30 or less than 20 or in the region of 15%.

The mean cross-sectional area of the pores may be less than 1.6 mm$^2$ or less than 0.25 mm$^2$ or more than 0.003 mm$^2$ or more than 0.012 mm$^2$ or in the region of 0.05 mm$^2$.

The mean cross-sectional area of the openings may be less than 2 mm$^2$ or less than 1.5 mm$^2$ or more than 0.05 mm$^2$ or more than 0.1 mm$^2$ or in the region of 1.2 mm$^2$.

The material may comprise vehicle sound absorbing material or construction sound absorbing material.

The mean cross-sectional dimension of the pieces in the material may be less than 10 or more than 0.5 or in the region of 3 to 5 mm.

At least one of the pores may be connected to at least one of the openings and preferably several pores are connected with several openings.

The material may be arranged to absorb more than 70 or more than 80 or more than 90% of the sound at at least one frequency. That frequency may be greater than 500 or greater than 600 or less than 6000 or less than 4000 or in the region of 800 Hz. Alternatively or additionally, that frequency may be more than 1100 or more than 1200 or less than 1600 or less than 1500 or in the region of 1300 Hz. The material may be arranged to absorb more than 70 or more than 80 or more than 90% of the sound at at least two spaced frequencies. The material may be arranged to absorb more than 30 or more than 40 or in the region of 50% or more of the sound at frequencies between the two spaced frequencies.

The material may comprise board material which may be less than 50 or less than 40 or more than 5 or in the region of 10 mm thick. The board material may be self supporting. The board material may be flexible.

The present invention also includes a method of using sound absorbing material as herein referred to comprising attaching the sound absorbing material to a vehicle or attaching the sound absorbing material to a construction.

The present invention also includes a method of making sound absorbing material comprising connecting a plurality of pieces together with each piece including pores extending at least partially into the pieces and the pieces also including openings extending at least partially through the material between adjacent pieces.

The method may comprise adhering the pieces together.

The method may comprise compressing the pieces, for instance by more than 25% or less than 75% or in the region of 50%.

The present invention also includes a method of making sound absorbing material as herein referred to.

According to a further aspect of the present invention a method of absorbing sound comprises using sound absorbing material as herein referred to.

The method may comprise sound travelling along a pore and then an opening connected to that pore or, alternatively or additionally, along an opening and then along a pore connected to that opening.

The present invention includes any combination of the herein referred to features or limitations.

BRIEF DESCRIPTION OF THE DRAWINGS

The present invention can be carried into practice in various ways but one embodiment will now be described, by way of example, and with reference to the accompanying drawings, in which.

DETAILED DESCRIPTION OF THE DRAWINGS

Figure 1:
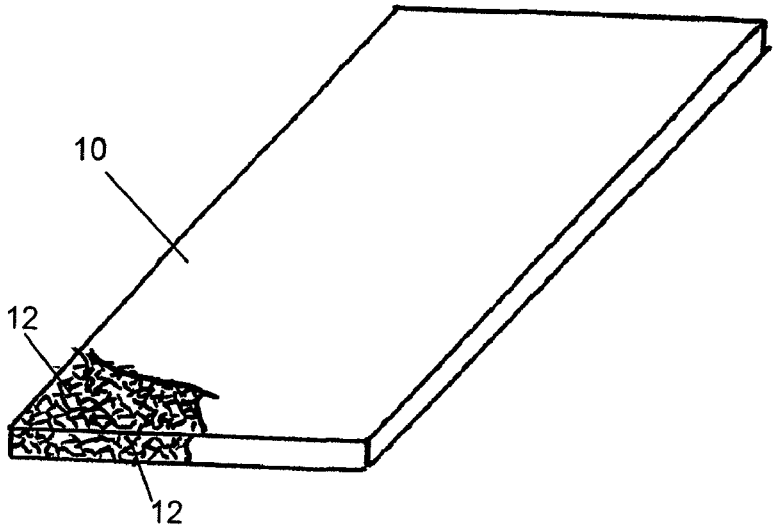
FIG. 1 is a perspective view of a finished sound absorber board 10.

The board 10 is made from recycled high density (100 or 120 kg/m$^3$) foam granulate 12 that has been mixed with a binder 14 and consolidated under pressure. (Each granule is approximately 3 to 6 mm wide). The pressure reduces the volume of the board to approximately ½ its original thickness and the porosity is reduced from 95% to 65%. The flow resistivity of the board is approximately 80K Pascals×sec/m$^2$ The board has a Youngs Modulus of $10^7$ Pascals and a Density of 400 kg/m$^3$. The relatively low amount of binder used represents around 35% by mass of the weight of the board. The board is able to support its own weight as a result of its relatively high Young's modulus and relatively low density. The board may be 10 mm thick.

The board includes large pores 16 comprising the spaces between the granules that comprise 15 to 20% of the volume of the board. Each granule includes small pores 18. Of the total pore volume, the large pores between the granules represents 10 to 15% of the pore volume and the small pores represent 85 to 90% of that total volume.

When sound energy enters the porous structure of the developed material part of it is absorbed as a result of the two physical processes: thermal diffusion and viscous friction. In the harmonic regime of an oscillating air flow in the material these processes are described by the thermal characteristic length $$\delta_t = \sqrt{\frac{k}{\rho c_p \omega}}$$

and by the viscous characteristic length $$\delta_v = \sqrt{\frac{\eta}{\rho \omega}},$$

where k is the thermal conductivity, ρ is the density, $c_p$ is the specific mass thermal capacity, η is the dynamic viscosity or air and $\omega=2\pi f$ is the angular frequency. For typical audio frequencies of $50<f<20000$ Hz these parameters are confined to ranges of 13 μm$<\delta_t<$0.26 mm and 10 μm$<\delta_v<$2.2 mm. The absorption of the acoustic energy is particularly pronounced when the size of pores and openings (which may be the length or width of the pores or openings) is close to either of the above characteristic lengths.

In the low frequency range isothermal conditions are set up and the viscous forces are the predominant mechanism of acoustic absorption. Thermal exchanges become more pronounced in the transitional frequency range, between the isothermal and adiabatic regimes. As the frequency of sound increases further adiabatic perturbations in the pores and openings become predominant. In this case, thermal exchanges are reduced and the absorption of sound is primarily because of the inertial interaction of the viscous fluid and the twisted pore structure.

Figure 2:
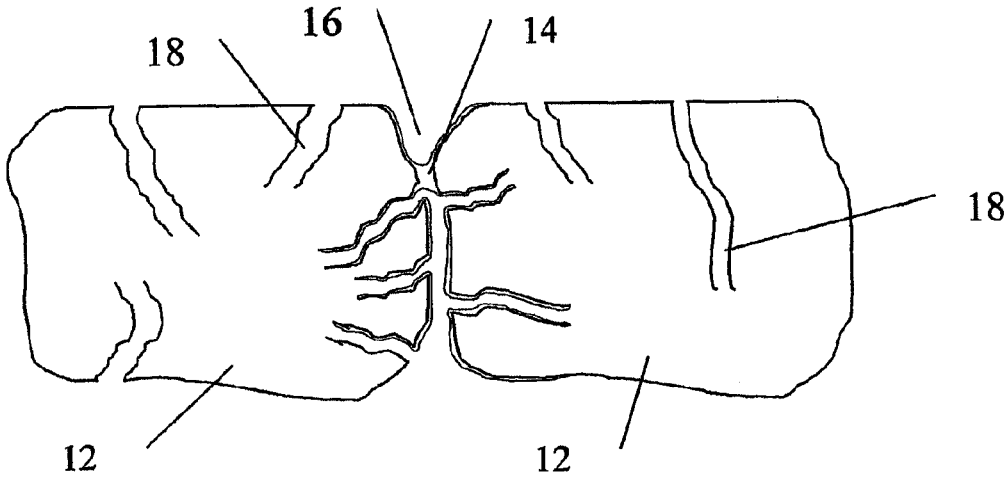
FIG. 2 is a detailed cross-sectional view of part of the board 10.

In a medium, in which small pores are connected to large openings the coupling of air flow between the pores and the openings is set up (see FIG. 2). In this case extra acoustic absorption is provided due to the additional viscous diffusion of the acoustic pressure in the pores and due to the additional thermal non-equilibrium in the dual porous system. Accordingly sound can enter the pores 16 and travel into the pores 18 or vice versa.

Accordingly, as the board includes both large and small pores sound is absorbed more effectively in a wide range of frequencies. Furthermore, the board may be relatively thin and yet still be able to absorb sound satisfactorily.

The tortuosity of the porous structure may be between 1 and 2.0 and is preferably in the region of 1.4.

The board has many uses including vehicle roofs, vehicle bumpers, vehicle seats or in insulating rooms such as by retrofitting rooms with the absorbing board. Clearly in these applications, the smaller the space that is occupied by the board the greater the remaining free space that is available. The board is able to be manufactured with various surface appearances including an apparent smooth surface to the eye.

Figure 3:
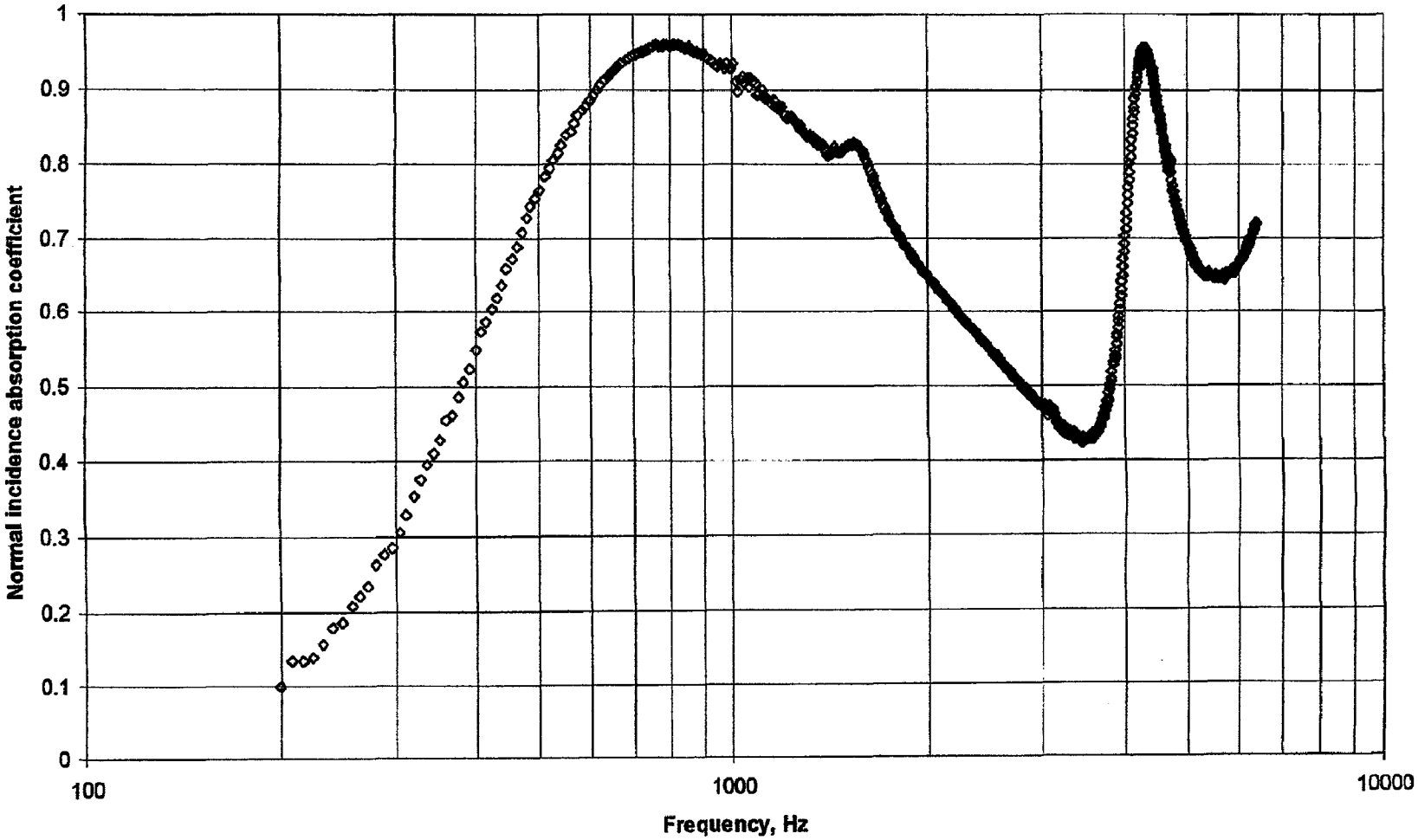
FIG. 3 is a graph showing how sound is absorbed by this board at different frequencies.

As shown in FIG. 3, when the sound is incident upon the 10 mm thick board with a 40 mm air spacing from a rigid layer behind the material, nearly all of the sound at 900 Hz is absorbed and nearly all of the sound at 1300 Hz is absorbed with the majority of sound between those frequencies also being absorbed. Sound of this frequency is most noticeable to the human ear.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment (s). The invention extend to any novel one, or any novel combination, of the features disclosed in this specification (including any accompanying claims, abstract and drawings), or to any novel one, or any novel combination, of the steps of any method or process so disclosed.

The invention claimed is:

1. A sound absorbing layer of material comprising a plurality of pieces, said pieces comprising foam pieces, said pieces being connected together by adhesive, each piece having a width of at least about 3 mm (0.118 in) and including pores extending at least partially into the pieces, said pores being open to the reception of sound, the material also including openings extending at least partially through the material between adjacent connected pieces in the layer—in which, in use, sound is arranged to travel along an opening and then along a pore connected to that opening.

2. Material as claimed in claim 1 in which the foam includes a density more than 25 kg/m$^3$ before the pieces are connected.

3. Material as claimed in claim 1 in which the foam has a density of less than 150 kg/m$^3$, before the pieces are connected.

4. Material as claimed in claim 1 that has been compressed down during manufacture.

5. Material as claimed in claim 1 having an initial porosity, before compression, of more than 80%.

6. A material as claimed in claim 1 which, prior to consolidation, has a flow resistivity of less than 300 kPascals×sec/m$^2$.

7. Material as claimed in claim 1 in which, prior to consolidation, has a flow resistivity of more than 20 kPascals×sec/m$^2$.

8. A material as claimed in claim 1 having a Youngs modulus of more than $10^5$ Pascals.

9. A material as claimed in claim 1 including a Youngs modulus of less than $10^9$ Pascals.

10. A material as claimed in claim 1 in which the pores are non-linear in their extent away from the surface of the pieces.

11. A material as claimed in claim 1 in which the size of the pores is in the region of the thermal characteristic length.

12. A material as claimed in claim 1 in which the size of the pores is in the region of the viscous characteristic length.

13. A material as claimed in claim 1 in which the size of the openings is in the region of the thermal characteristic length.

14. A material as claimed in claim 1 in which the size of the openings is in the region of the viscous characteristic length.

15. A material as claimed in claim 1 in which the ratio of the space provided by the pores to the total space in the material is more than 60%.

16. A material as claimed in claim 1 in which the ratio of the space provided by the pores to the total space in the material is in the region of 85%.

17. A material as claimed in claim 1 in which the ratio of the space provided by the openings to the total space in the material is less than 40%.

18. A material as claimed in claim 1 in which the ratio of the space provided by the openings to the total space is in the region of 15%.

19. A material as claimed in claim 1 in which the mean cross-sectional area of the pores is less than 1.6 $mm^2$.

20. A material as claimed in claim 1 in which the mean cross-sectional area of the pores is more than 0.003 $mm^2$.

21. A material as claimed in claim 1 in which the mean cross-sectional area of the openings is less than 2 $mm^2$.

22. A material as claimed in claim 1 in which the mean cross-sectional area of the openings is more than 0.05 $mm^2$.

23. Material as claimed in claim 1 in which the mean cross-sectional dimension of the pieces in the material is less than 10 mm.

24. Material as claimed in any claim 1 in which at least one of the pores is connected to at least one of the openings.

25. Material as claimed in claim 1 in which several pores are connected with several openings.

26. Material as claimed in claim 1 arranged to absorb more than 70% of sound at least two spaced frequencies.

27. Material as claimed in claim 26 arranged to absorb more than 30% of the sound at frequencies between the two spaced frequencies.

28. Material as claimed in claim 1 in which the material is more than 5 mm thick.

29. Material as claimed in claim 1 comprising board material, said board material being self supporting.

30. A method of making sound absorbing material comprising connecting a plurality of pieces together with adhesive in a layer, said pieces comprising foam pieces, each piece having a width of at least about 3 mm (0.118 in) and including pores extending at least partially into the pieces, said pores being open to the reception of sound, and the material also including openings extending at least partially through the material between adjacent connected pieces with at least one pore being connected to at least one of the openings in which, in use, sound is arranged to travel along an opening and then along a pore connected to that opening.

31. A method as claimed in claim 30 comprising compressing the pieces.

32. A method of absorbing sound using material as claimed in claim 30 comprising sound travelling along a pore and then an opening connected to that pore.

* * * * *